US007407461B2

(12) United States Patent
Numberger et al.

(10) Patent No.: US 7,407,461 B2
(45) Date of Patent: Aug. 5, 2008

(54) GATHERER STITCHER HAVING TWO OPERATING SHAFTS

(75) Inventors: Michael Numberger, Denkingen (DE); Dirk Droege, Neuhausen Ob Eck (DE); Thomas Gerlach, Tuttlingen (DE); Claus-Otto Hohner, Tuttlingen (DE)

(73) Assignee: Hohner Maschinenbau GmbH, Tuttlingen (DE)

( * ) Notice: Subject to any disclaimer, the term of this patent is extended or adjusted under 35 U.S.C. 154(b) by 49 days.

(21) Appl. No.: 11/076,281

(22) Filed: Mar. 10, 2005

(65) Prior Publication Data

US 2005/0201850 A1 Sep. 15, 2005

(30) Foreign Application Priority Data

Mar. 10, 2004 (DE) ..... 10 2004 011 978

(51) Int. Cl.
*B42B 2/00* (2006.01)

(52) U.S. Cl. ..... 475/331; 412/35

(58) Field of Classification Search ..... 475/7, 475/149, 317

See application file for complete search history.

(56) References Cited

U.S. PATENT DOCUMENTS

| | | | | |
|---|---|---|---|---|
| 2,693,595 A | | 11/1954 | Belluche et al. | |
| 3,077,602 A | | 2/1963 | Cirillo et al. | |
| 3,413,920 A | | 12/1968 | Kaneko et al. | |
| 3,763,798 A | | 10/1973 | Bottcher | |
| 4,791,869 A | * | 12/1988 | Furukawa | 101/232 |
| 5,415,595 A | * | 5/1995 | Nelson | 475/7 |
| 6,030,165 A | * | 2/2000 | Ishida | 412/35 |

FOREIGN PATENT DOCUMENTS

| | | |
|---|---|---|
| DE | 38 10 457 A1 | 11/1988 |
| DE | 35 10 878 C2 | 1/1990 |
| DE | 197 52 015 A1 | 5/1999 |
| EP | 0 318 605 A1 | 6/1989 |
| EP | 0 727 379 A2 | 8/1996 |
| EP | 0 727 379 A3 | 10/1996 |
| EP | 0 761 472 A1 | 3/1997 |
| EP | 1 502 889 A2 | 2/2005 |
| GB | 544830 | 1/1941 |
| WO | WO 88/06 563 A1 | 9/1988 |

* cited by examiner

*Primary Examiner*—Richard M. Lorence
*Assistant Examiner*—Edwin A Young
(74) *Attorney, Agent, or Firm*—Breneman & Georges

(57) ABSTRACT

A gatherer stitcher is provided having a common drive unit driving at least two operating shafts, at least one and/or at least two different operating units, such as more particularly a gatherer chain and/or stitching station and/or a feeder and/or stitching carriage and/or ejector and/or 3-cutter, comprising two operating shafts, which permits an automated change in the phase angle between the two shafts. According to the invention, this is achieved in that an adjusting apparatus having at least one adjustment drive (4) that can be monitored is provided in order to set a phase angle at least between the two shafts.

17 Claims, 3 Drawing Sheets

GATHERER STITCHER HAVING TWO OPERATING SHAFTS

Figure 1:
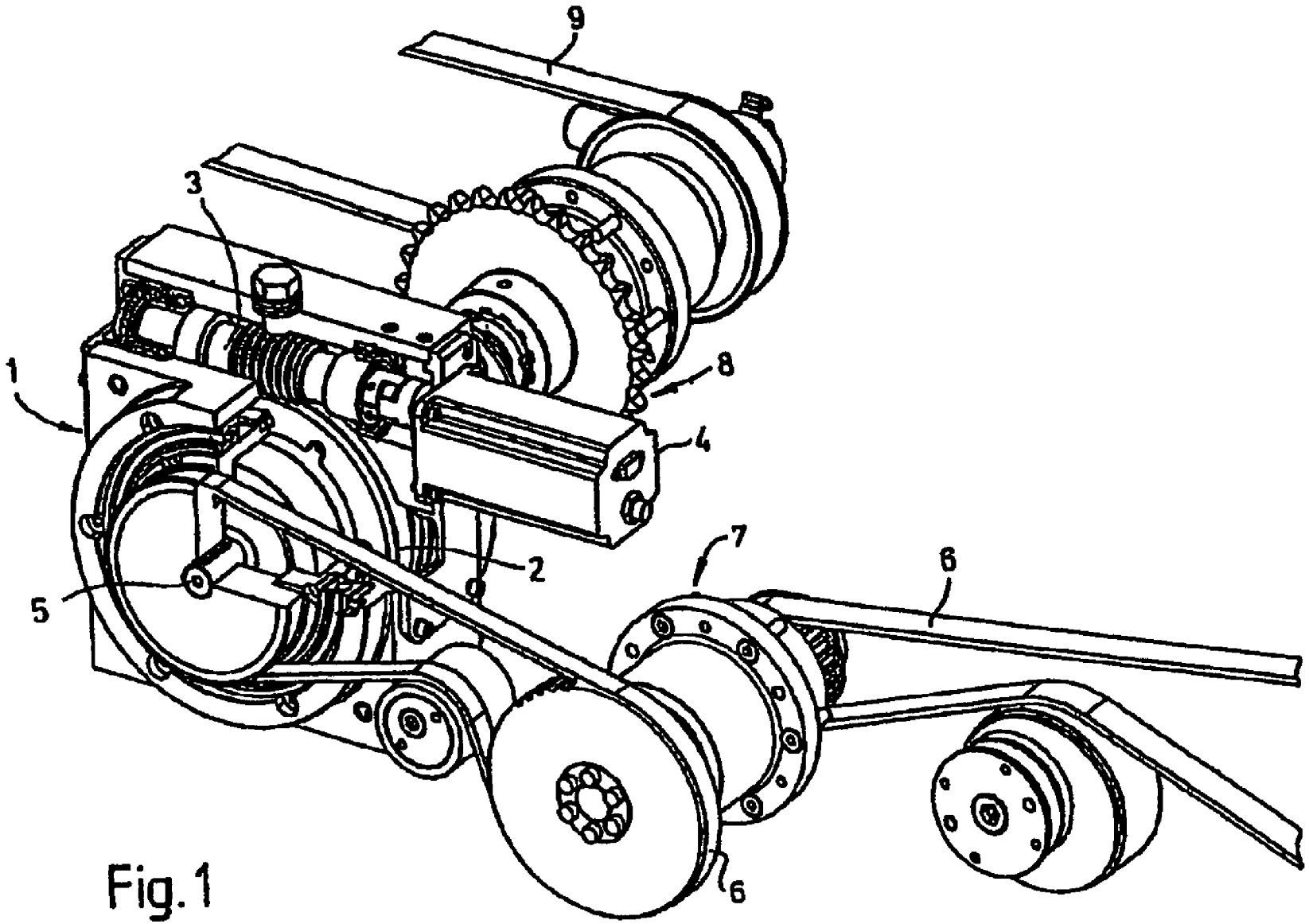

BACKGROUND OF THE INVENTION (1) Field of the Invention

The invention relates to a gatherer stitcher having a common drive unit driving at least two operating shafts operating at least one and/or at least two different operating units, where the operating shafts can include in particular a gatherer chain and/or stitching station and/or a feeder and/or a stitching carriage and/or an ejector and/or a 3-cutter. More particularly the invention pertains to an adjusting apparatus having at least one adjustment drive that can be controlled to set a phase angle between the two operating shafts.

(2) Description of Related Art Including Information Disclosed Under 37 CFR 1.97 and 1.98

Gatherer stitchers are generally paper-processing machines with which a product, for example a brochure, is assembled from a plurality of folded sheets and is stitched. Printed folded sheets from stacks, lying on folded sheet feeders or standing on the spine, are supplied in separated form, opened and placed on a gatherer chain. The number of folded sheets to be stitched is gathered and aligned on the gatherer chain by means of drivers. The gatherer chain transports the gathered folded sheets to a stitching device, where these are stitched with wire staples by means of stitching heads. In order to trim the edge of the stitched products, what is known as a trimmer (3-cutter) is normally provided after the ejector, from which the end products are transported onward to a delivery. If appropriate, perforation of the products can be provided.

In gatherer stitchers, two stitching principles can expediently be employed: stitching at a standstill or stitching on the moving product. In order to perform stitching on the moving product, the stitching device, comprising stitching carriage and bending-over device or stitching station, has to be moved together with the product to be stitched and has to be coordinated with the movement of the latter, at least for some time.

The gatherer stitcher is often driven by a central electric motor. In this case, the various subassemblies, such as the stitching apparatus, the gatherer chain, the folded sheet feeder, the ejector, the trimmer and possibly further components are driven by various gear mechanisms and a common shaft, what is known as a king shaft.

The respective subassembly comprises at least one operating shaft driven by the common shaft in order to fulfill its function, and to some extent there is also a plurality of operating shafts per subassembly. For instance, a folded sheet feeder has three corresponding shafts, in order to pull off the sheet and to open it in order to lay it on the gatherer chain.

Gatherer stitchers are often intended to be able to process an extremely wide range of sheets. For instance, papers of different size and/or different strengths are to be processed. For this purpose, it is to some extent necessary to adjust the phase angle between the operating shafts of different subassemblies and/or between the operating shafts of a subassembly. Hitherto, this has been carried but by hand, which is very time-consuming and to some extent relatively inaccurate.

BRIEF SUMMARY OF THE INVENTION

It is an object of the invention to provide a gatherer stitcher having a common drive unit driving at least two operating shafts, at least one or two different operating units which include the operating shafts, which permits an automated change of the phase angle between two shafts.

On the basis of a gatherer stitcher of the type mentioned in the introduction, this object is achieved by having an adjustment apparatus with at least one controlled adjustment drive to set a phase angle between two operating shafts.

Advantageous embodiments and developments of the invention are achieved by having an electric motor (4, 20) as the adjustment drive, having a position control or a position regulation on the electric motor, having a spindle or worm gear mechanism (2, 3, 19, 18) as an adjustment apparatus, having an epicyclic gear mechanism (1) in the adjustment apparatus, having an internal gear (2) of the epicyclic gear mechanism (1) with internal teeth in which the internal teeth are stationary in the first operating phase and is moved in a second operating phase with the aid of an adjustment drive (4), having a spindle or worm gear mechanism (3) adjust the internal gear (2), having the adjustment drive (4, 20) disposed between a drive of a gatherer chain and a stitching station and/or the stitching carriage, having at least one of the operating shafts (11, 12, 13) operatively connected via a tension-transmitting transmission element (15), having the transmission element as a belt, chain, band and/or cable, varying the length of the transmission element (15) between the operating shafts (12, 13) having at least one operating shaft (11, 12, 13) and/or deflection element (17) arranged on at least one pivotable lever arm (16) having the spindle or worm gear mechanism (18, 19) pivot the lever arm (16) and having the adjustment drive (4, 20) arranged between a drive of the gatherer feeder chain and/or a drive of the feeder (10) for feeding sheets to the gatherer chain and/or one or two sheet opener shafts (12, 13) of the feeder (10).

Accordingly, a gatherer stitcher according to the invention is distinguished by the fact that an adjustment apparatus having at least one adjustment drive that can be monitored is provided for adjusting a phase angle at least between the two shafts. In the sense of the invention, operating shafts are understood to be both shafts which fulfill an operating function and shafts driving other shafts, that is to say a drive function or the operating function is the drive of other shafts, like what is known as the king shaft.

With the aid of an adjustment apparatus according to the invention with an adjustment drive, while maintaining the rigid mechanical coupling between the drive shafts or between the drive units, a change in the phase angle can be implemented in a particularly elegant manner, is automated and is preferably monitored or controlled by a control/monitoring unit which is to some extent already present. This means that, through the mechanical rigid coupling of the shafts, for example the synchronization of the operating shafts is reliably ensured and, at the same time, flexible adaptation to an extremely wide range of requirements or sheets can be carried out in an automated manner.

The adjustment drive is preferably formed as an electric motor, in particular with positioning control/regulation. This ensures that, for example, commercially available drives can be used. The positioning control/regulation of the electric motor ensures particularly accurate adjustability of the phase angle between the operating shafts. In this positioning control/regulation, it is particularly advantageous that it perceives and, if necessary, corrects rotation on account of external influences.

In a particular development of the invention, the adjustment drive comprises a spindle or worm gear mechanism. With the aid of the spindle/worm gear mechanism, self-locking adjustment can be achieved with high force transmission. Furthermore, given an advantageous configuration of the spindle/worm gear mechanism, particularly high accuracy of the control/regulation can be achieved. For example, comparatively many increments of the motor or of a rotary encoder per degree of phase adjustment can be provided. Given an advantageously small resolution of the adjustment, extremely exact setting of the phase angle between the shafts can be implemented.

In an advantageous variant of the invention, the adjustment drive has an epicyclic gear mechanism. By using this, a particularly complex design can be implemented. Furthermore, commercially available components can be used economically. Using an epicyclic gear mechanism, an unlimited change in the phase angle can be implemented, that is to say from 0-360° and a multiple of a complete revolution.

An internal gear of the epicyclic gear mechanism, provided with internal toothing, is stationary in a first operating phase and is moved with the aid of the adjustment drive in a second operating phase in order to adjust the phase angle. In the first operating phase, a rigid mechanical coupling and synchronization of the operating shafts is reliably ensured without, in general, further measures such as separate, electronic drives being needed. In this way, the susceptibility of the gatherer stitcher to faults is reduced considerably as compared with electronic systems. In the second operating phase, the phase angle between the operating shafts is advantageously changed. This can be done, for example, in a rest phase of the operating unit or of the gatherer stitcher and/or during an operating phase of the operating shafts.

The adjustment of the phase angle between the two shafts during their operating phase leads in an elegant way to an acyclic operating mode of the shafts, which opens up further possible applications. Furthermore, the setting of the exact phase angle with the shafts running is possible, for example during test operation or the like.

The spindle/worm gear mechanism is preferably designed to adjust the internal gear. For instance, in addition to the internal toothing, the internal gear also has external toothing, which is operatively connected to the spindle/worm gear mechanism. In this way, the number of parts of the adjustment drive is advantageously reduced, so that the effort on design and also the financial outlay are reduced.

In an advantageous embodiment of the invention, the adjustment drive is arranged between a drive of the gatherer chain and the stitching station and/or the stitching carriage. In this way, advantageous adaptation of the two operating units and their phase angle in relation to each other is implemented.

As an alternative to the epicyclic gear mechanism or in combination with the latter, at least the operating shafts are operatively connected via a tension-transmitting transmission element. For example, the transmission element used is a belt, in particular toothed belt, V belt, etc., and/or a chain, band and/or a cable. Appropriately flexible, endless transmission elements can already be obtained on the market in an extremely wide range of variants and sizes, so that it is also possible here to fall back on economical components.

Advantageously, a length of the transmission element between the operating shafts can be varied. This means, for example, that the length of the run of the transmission element is changed, in particular shortened. For instance, one operating shaft remains stationary and the other, second operating shaft is moved or rotated with the aid of the adjustment drive according to the invention, the length of the transmission element between the two shafts being changed. This advantageously implements the automated phase adjustment according to the invention.

In a particular development of the invention, at least one operating shaft and/or a deflection element are arranged on at least one pivotable lever arm. With the aid of the pivotable lever arm according to the invention, the advantageous adjustment of the length of the transmission element between the operating shafts can advantageously be implemented.

The adjustment of the length of the transmission element between the shafts can be achieved, for example, by means of a reciprocating cylinder, lever and/or crank mechanism, a rail arrangement or the like. The spindle or worm gear mechanism is preferably formed so as to pivot the lever arm. In this way, a particularly constructionally advantageous exemplary embodiment of the invention can be achieved with high force transmission and precise monitoring of the phase adjustment.

In an advantageous embodiment of the invention, the adjustment drive is arranged between a drive of the gatherer chain and/or a drive of the feeder for feeding sheets to the gatherer chain and/or one or two sheet opener shafts of the feeder. This measure in particular permits adaptation of the gatherer stitcher to an extremely wide range of sheets and papers. This widens the flexibility of the gatherer stitcher according to the invention.

BRIEF DESCRIPTION OF THE SEVERAL VIEWS OF THE DRAWING(S)

Figure 2:
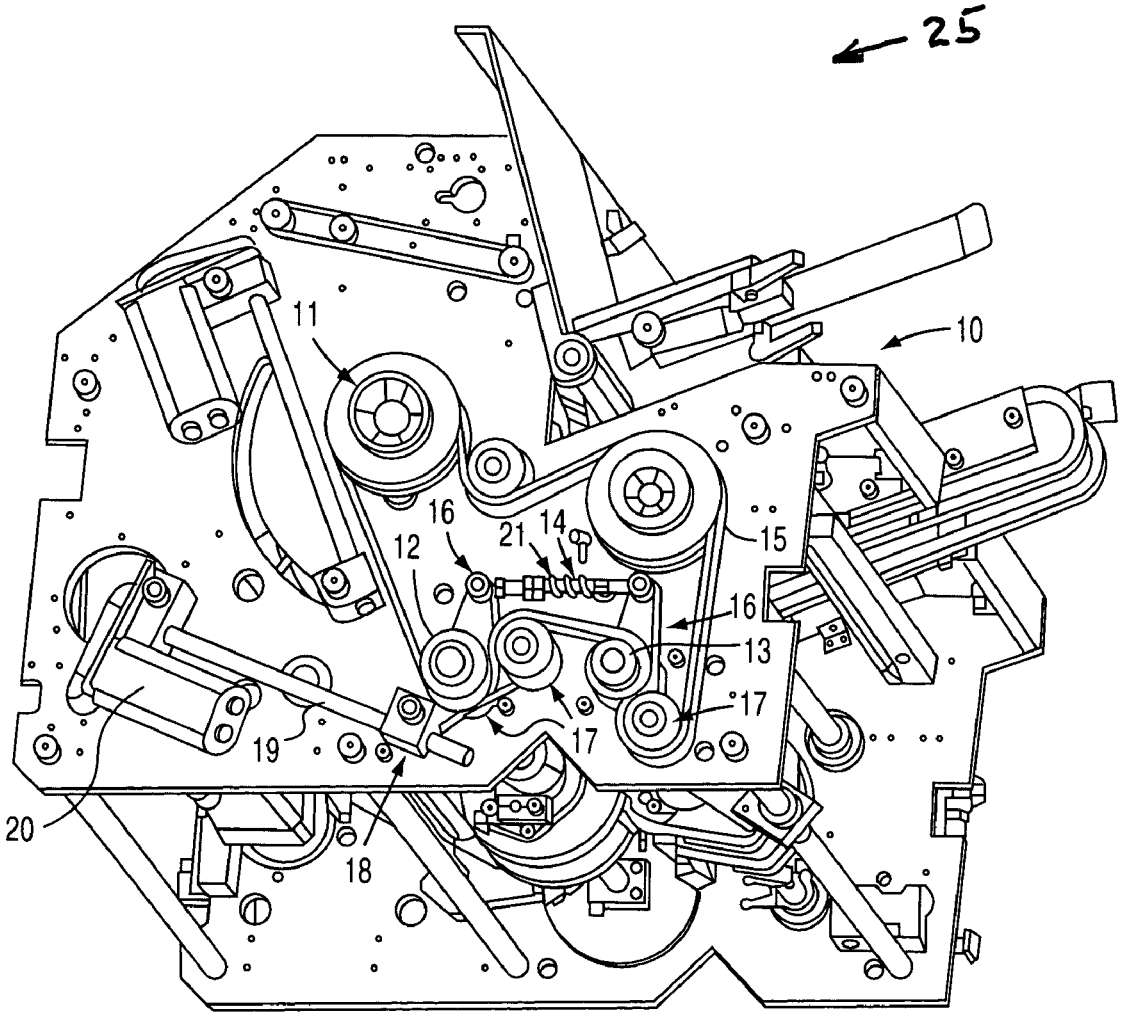
Figure 3:
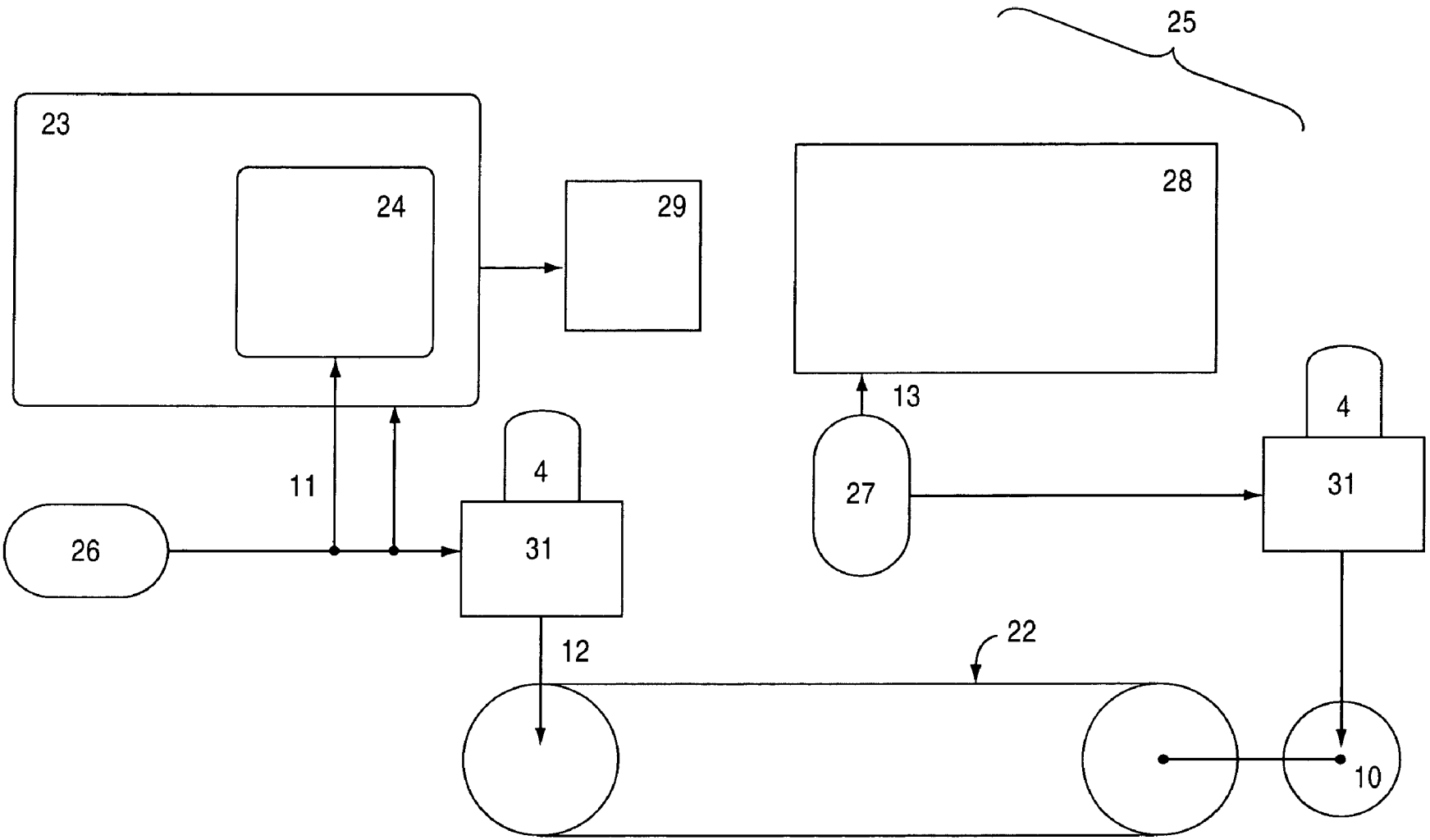

An exemplary embodiment of the invention is illustrated in the drawing and will be explained in more detail in the following text by using figures, in which, in detail:

FIG. 1 shows a schematic, perspective illustration of a first phase adjustment apparatus according to the invention having an epicyclic gear mechanism, FIG. 2 shows a schematic, perspective illustration of a second phase adjustment apparatus according to the invention; and FIG. 3 schematically illustrates the adjustment apparatus, gatherer chain, stitching station, stitching carriage, 3 cutter ejector and 3 cutter combinations and respective drives as shown in FIG. 2.

DETAILED DESCRIPTION OF THE SEVERAL VIEWS OF THE INVENTION INCLUDING BEST MODE

An adjustment apparatus according to the invention having an epicyclic gear mechanism 1 is illustrated schematically in FIG. 1. A worm gear 3, which is driven by an electric motor 4, engages in the internal gear 2 of the epicyclic gear mechanism 1. The motor 4 can be, for example, a stepping motor or electric motor with positioning control and/or regulation, in particular a direct current motor.

A gear shaft 5 represents the shaft of a sun wheel, not specifically illustrated, of the epicyclic gear mechanism 1. The drive of the shaft 5 is provided via a drive, not specifically illustrated, of the gatherer stitcher according to the invention and is led to the shaft 5 from said drive via belts 6 and a transmission 7.

The epicyclic gear mechanism 1 has, for example, a transmission ratio of 3:1 with respect to the output 8. The transmission 7 is advantageously 1:3, so that the entire unit has a transmission ratio of 1:1 overall. This means that the drive, not specifically illustrated, runs synchronously or with the same phase as the output 8.

In order to adjust a phase angle between the drive 5 and the output 8 of the epicyclic gear mechanism or operating shafts correspondingly not specifically illustrated, which are driven by the belts 6 and 9, in a particular operating phase of the epicyclic gear mechanism 1, the motor 4 and the worm gear 3 are operated and set rotating. In this way, the internal gear 2 is rotated, comprising both internal toothing for the planet wheels and also external toothing for the worm gear 3 (without specific illustration), which means that a relative movement between drive shaft 5 and the planet wheels, not specifically illustrated, of the epicyclic gear mechanism is achieved, so that the output 8 rotates relative to the shaft 5. This rotation effects a phase offset between the drive motor and the output 8. This means that there is a direct relationship between the rotation of the worm gear 3 and the phase offset between the drive motor and the output 8, so that an exact setting of the appropriate phase offset is achieved by means of advantageously driving the motor 4.

For example, the phase offset is changed while the shaft 5 is at a standstill and the output 8 is rotated or adjusted by the motor 4 on account of the action. The transmission ratio in this case can be, for example, 3:2. If appropriate, the phase offset can also be carried out during a rotational phase of the shaft 5, the angular speed of the output shaft 8 being different from that of the shaft 5. The phase offset depends only on the duration of the rotation or the number of revolutions of the worm gear 3.

The adjustment apparatus having the epicyclic gear mechanism 1 according to FIG. 1 can preferably be provided for adjusting the phase offset between the gatherer chain and the stitching carriage and/or between gatherer chain and feeder or other components of the gatherer stitcher.

A further embodiment of the invention for producing a phase offset of sheet opener drums of a feeder 10 of the gatherer stitcher 25 is illustrated in FIGS. 2 and 3. A folded sheet feeder 10 has three shafts 11, 12, 13, also known as the drums. The shaft 11 is used to pull off a sheet and the opener shafts 12 and 13 open the sheet. The sheet is then deposited with the sides pointing downward and opened on a support, not specifically illustrated, for the onward transport. The shafts 12 and 13 are at the same height as each other and rotate in opposite directions.

For example, after being pulled off by the shaft 11, the folded sheet is pulled with the spine against a stop with the aid of suckers and/or gripping tongs, not specifically illustrated, and remains lying with the open sides pointing toward the shafts 12 and 13. Shaft 12 grips the sheet at the open sides with its tongs, for example, and leads said sheet between the shaft 13 rotating in the opposite direction. At a predefined time, the shaft 13 opens the sheet with the aid of grippers and/or suckers. The two opener shafts 12, 13 hold said sheet until it has been opened to such an extent that it can be deposited advantageously, in particular on a gatherer chain 22.

The shafts 11, 12 are generally set firmly in relation to each other and maintain their position in relation to each other during an operating cycle. This means that the shafts 11 and 12 are synchronized with each other. The shaft 13 must be adjusted in relation to the shaft 12, depending on the sheet and fold composition. For this purpose, according to the invention the phase angle between the shaft 13 and the two other shafts 11, 12 is adjusted.

The shafts 11, 12, 13 are connected to one another with the aid of a belt 15, in particular toothed belt 15. The shaft 11 is driven by a motor, not specifically illustrated. The three shafts 11, 12, 13 have appropriate toothed sprockets.

In this variant of the invention, the deflection rollers 17 are in each case mounted such that they can be pivoted with the aid of a lever 16, at the ends of which a rod 14 and deflection roller 17 are arranged. On the lever 16, a spindle nut 18 is seated on the shaft 12 at a predefined angle. This is adjusted and moved with the aid of a motor 20 or a spindle 19 driven by the latter. The two levers 16 of the shafts 12, 13 are connected to each other by a rod 14.

All the shafts 11, 12, 13 are firmly coupled mechanically to one another via the common toothed belt 15 and the advantageous guidance of the toothed belt 15 over the deflection rollers 17. The shaft 13 is located between the additional deflection rollers 17. A predefined basic setting defines the phase angle of the shafts 11, 12, 13 in relation to one another. If the threaded spindle 19 or worm gear 19 is rotated by the motor 20, then the nut 18 or the lever 16 is moved on the shaft 12, so that in turn the lever 16 is concomitantly moved on the shaft 13 by the rod 14. This is implemented in approximately equal degrees of arc. Any stress additionally caused by this in the toothed belt 15 can be absorbed by a spring 21 belonging to the rod 14.

The rotation of the lever 16 also has the effect that the additional rollers 17 are raised or lowered together and the toothed belt 15 is moved between the two shafts 12, 13. This means that the length of the toothed belt 15 between the two shafts 12 and 13 is changed, which leads to a change in the phase angle between the two shafts 12, 13 according to the invention. The movement of the toothed belt 15 necessarily leads to corotation of the shaft 13. The region of the belt between the shafts 11 and 12 and the shafts 11 and 13 is not adjusted, since the shaft 11, that is to say the main drive of the feeder 10, is not rotated or is firmly connected to a drive motor, in particular of the gatherer stitcher.

Referring now to FIGS. 1, 2 and 3 a gatherer stitcher 25 has a common drive unit 4 driving at least two operating shafts 11, 12 and 13 operating at least one or at least two different operating units, where the operating shafts can include in particular a gatherer chain 22 and/or stitching station 23 and/or a feeder 10 and/or a stitching carriage 24 and/or an ejector 29 and/or a 3-cutter 28. The invention pertains to the adjusting apparatus having the epicyclic gear mechanism as the at least one adjustment drive 4, 20 that can be controlled to set a phase angle between the two operating shafts which permits an automated change of the phase angle between the two shafts.

The advantages of the invention are achieved by having an electric motor 4, 20 as the adjustment drive, having a position control or a position regulation on the electric motor, having a spindle or worm gear mechanism 2, 3, 19, 18 as an adjustment apparatus, having an epicyclic gear mechanism 1 in the adjustment apparatus, having an internal gear 2 of the epicyclic gear mechanism 1 with internal teeth in which the internal teeth are stationary in the first operating phase and is moved in a second operating phase with the aid of an adjustment drive 4, having a spindle or worm gear mechanism 3 adjust the internal gear 2, having the adjustment drive 4, 20 or adjustment apparatus 31 disposed between a drive 26 of a gatherer chain 22 and a stitching station 23 and/or the stitching carriage 24 provided by shaft 11, having at least one of the operating shafts 11, 12, 13 operatively connected via a tension-transmitting transmission element 15, having the transmission element as a belt, chain, band and/or cable, varying the length of the transmission element 15 between the operating shafts 12, 13 having at least one operating shaft 11, 12, 13 and/or deflection element 17 arranged on at least one pivotable lever arm 16 having the spindle or worm gear mechanism 18, 19 pivot the lever arm 16 and having the adjustment drive 4, 20 or adjustment apparatus 31 arranged between a drive 26, 27 of the gatherer feeder chain and/or a drive of the feeder 10 for feeding sheets to the gatherer chain and/or one or two sheet opener shafts 12, 13 of the feeder 10.

In an advantageous embodiment of the invention, the adjustment drive is arranged between a drive 27 of the gatherer chain 22 and/or a drive of the feeder 10 for feeding sheets to the gatherer chain and/or one or two sheet opener shafts 12, 13 of the feeder 10. This measure in particular permits adaptation of the gatherer stitcher to an extremely wide range of sheets and paper. This widens the flexibility of the gatherer stitcher in accordance with the invention.

LIST OF DESIGNATIONS

1 Epicyclic gear mechanism
2 Internal gear
3 Worm gear
4 Motor
5 Shaft
6 Belt
7 Transmission
8 Output
9 Belt
10 Feeder
11 Shaft
12 Shaft
13 Shaft
14 Rod
15 Belt
16 Lever
17 Roller
18 Nut
19 Spindle
20 Motor
21 Spring
22 gatherer chain
23 stitching station
24 stitching carriage
25 gatherer stitcher
26 drive
27 drive
28 3-cutter
29 ejector
31 adjusting apparatus.

What is claimed is:

1. A device for adjusting the phase angle between two operating shafts in a gatherer stitcher comprising:

(a) two operating shafts of a gatherer stitcher in which one of the two operating shafts operates a gatherer belt or chain;

(b) a common drive unit for operating said two operating shafts;

(c) an adjustable phase angle drive for adjusting the phase angle between said two operating shafts or between said common drive unit and one of said two operating shafts; and (d) wherein the two operating shafts operate a single operating unit or two different operating units selected from the group consisting of:

(e) a stitching station, a feeder, a stitching carriage, an ejector and a 3-cutter.

2. A gatherer stitcher comprising at least two operating shafts commonly driven by a common drive unit wherein the at least two operating shafts (11, 12, 13) are disposed in at least one operating unit or two different operating units and at least one of said operating shafts operates a gatherer chain and wherein the at least one or two different operating units are selected from the group consisting of:

a stitching station, a feeder, a stitching carriage, an ejector and a 3-cutter; and an adjustment apparatus having at least one controlled adjustment drive (4, 20) to set a phase angle between the at least two operating shafts (11, 12, 13).

3. The gatherer stitcher as claimed in claim 2 wherein the adjustment apparatus (4, 20) is an electric motor (4, 20).

4. The gatherer stitcher as claimed in claim 2 or 3 wherein the adjustment apparatus (4, 20) has a positioning control or positioning regulation.

5. The gatherer stitcher as claimed in claim 2 or 3 wherein the adjustment apparatus has a spindle or worm gear mechanism (2, 3, 19, 18).

6. The gatherer stitcher as claimed in claim 2 or 3 wherein the adjustment apparatus has an epicyclic gear mechanism (1).

7. The gatherer stitcher as claimed in claim 6 wherein the epicyclic gear mechanism (1), has an internal gear (2) with internal toothing, which is stationary in a first operating phase and is moved with the aid of the adjustment apparatus (4) in a second operating phase.

8. The gatherer stitcher as claimed in claim 7 wherein an internal gear (2) has a spindle or worm gear mechanism (3) to adjust the internal gear (2).

9. The gatherer stitcher as claimed in claim 2 or 3 wherein at least one of the operating shafts (11, 12, 13) is operatively connected to the common drive unit via a tension-transmitting transmission element (15).

10. The gatherer stitcher as claimed in claim 9 wherein the transmission element (15) is a belt (15), a chain, a band or a cable.

11. The gatherer stitcher as claimed in claim 10 wherein a length of the transmission element (15) can be varied between the operating shafts (12, 13).

12. The gatherer stitcher as claimed in claim 2 further comprising a deflection element (17) and at least one pivotable lever arm (16).

13. The gatherer stitcher as claimed in claim 12 wherein a spindle or worm gear mechanism (18, 19) is provided to pivot the pivotable lever arm (16).

14. The gatherer stitcher as claimed in claim 2 wherein the adjustment apparatus is disposed between at least a drive of the gatherer chain and a drive of the stitching station and a drive of the stitching carriage.

15. A gatherer stitcher comprising at least two operating shafts commonly driven by a common drive unit in which one of the two operating shafts operates a gatherer belt or chain and wherein the at least two operating shafts are disposed in at least one operating unit or two different operating units wherein the at least one or two different operating units are selected from the group consisting of:

a stitching station, a feeder, a stitching carriage, an ejector and a 3-cutter; and an adjustment apparatus having at least one controlled adjustment drive to set a phase angle between the at least two operating shafts wherein the adjustment apparatus is disposed between at least a drive of the gatherer belt or chain, a drive of the feeder, an ejector or a 3-cutter.

16. A gatherer stitcher comprising at least two operating shafts (11, 12, 13) which shafts (11, 12, 13) are commonly driven by a common drive unit and at least one of the two operating shafts operates a gatherer belt or chain and wherein the at least two operating shafts (11, 12, 13) are disposed in at least one operating unit or two different operating units wherein the operating units are selected from the group consisting of:

a stitching station, a feeder, a stitching carriage, an ejector, a 3-cutter and one or two opener shafts (12) (13); and an adjustment apparatus having at least one controlled adjustment drive (4, 20) to set a phase angle between the at least two operating shafts (11, 12, 13) and a drive of the gatherer belt or chain and one or two sheet opener shafts (12, 13) of the feeder (10).

17. A gatherer stitcher having at least two operating shafts driven by a common drive unit wherein one of said at least two operating shafts operates a gatherer belt or chain and said at least two operating shafts are disposed in one or more operating units selected from the group consisting of:

a stitching station, a feeder, a stitching carriage, an ejector, a 3 cutter and one or more opener shafts;

a first automatic phase adjustment apparatus having an epicyclic gear mechanism to provide a first controlled adjustment drive to set a phase angle between said at least two operating shafts; and a second automatic phase adjustment apparatus having a deflection roller and driven by a separate motor.

* * * * *